United States Patent [19]

Kuijer et al.

[11] 4,064,291

[45] Dec. 20, 1977

[54] SPRAY-COATING METHOD OF WINDOW FORMING IN TUBULAR LAMP

[75] Inventors: William Lodewijk Kuijer; Peter Ivan Sygall; Paulus Johannes Wennekes, all of Eindhoven, Netherlands

[73] Assignee: U.S. Philips Corporation, New York, N.Y.

[21] Appl. No.: 735,321

[22] Filed: Oct. 26, 1976

[30] Foreign Application Priority Data

Nov. 4, 1975 Netherlands ..... 7512882

[51] Int. Cl.[2] ..... B05D 1/02; H01K 7/02

[52] U.S. Cl. ..... 427/106; 118/317; 427/233

[58] Field of Search ..... 118/306, 317; 427/28, 427/71, 106, 110, 181, 168, 161, 236, 105, 107, 157, 158; 239/561, 567, 568; 313/488

[56] References Cited

U.S. PATENT DOCUMENTS

| | | | |
|---|---|---|---|
| 2,619,430 | 11/1952 | Fink | 427/106 |
| 2,895,449 | 7/1959 | Oldfield, Jr. | 118/317 X |
| 2,930,531 | 3/1960 | Kennedy, Jr. | 239/561 X |
| 3,019,938 | 2/1962 | Miller et al. | 118/317 X |
| 3,204,604 | 9/1965 | Barich et al. | 118/317 X |
| 3,421,701 | 1/1969 | Walters | 118/317 X |
| 3,809,944 | 5/1974 | Jongerius et al. | 313/488 X |

*Primary Examiner*—Morris Kaplan

*Attorney, Agent, or Firm*—Frank R. Trifari; Robert S. Smith

[57] ABSTRACT

A method of applying a longitudinally extending coating of a reflecting or luminescent material in a tubular lamp by means of a nozzle which travels along the longitudinal axis of the lamp envelope. A plurality of spraying jets are so disposed that the suspension or solution, lands on a portion of the envelope immediately adjacent to the slot to be formed.

2 Claims, 5 Drawing Figures

SPRAY-COATING METHOD OF WINDOW FORMING IN TUBULAR LAMP

The invention relates to a method of applying a coating of a suspension or solution to the inner wall of a tubular lamp, which coating is provided with a longitudinal slot. It will be understood that the term slot as used herein refers to an arcuate region on the interior of the tubular lamp envelope which extends parallel to the axis of the lamp envelope with sides generally parallel to said axis of said lamp.

In order to increase the light output of a tubular lamp into a given direction, a reflecting coating, for example $TiO_2$ is applied to a portion of the inner surface. Thereafter the entire wall is coated with the fluorescent material. A longitudinal slot can also be applied in lamps whose inner wall is coated with a layer of fluorescent material only, for example lamps which are used in xerographic apparatus. The longitudinal slot may be made in the reflecting coating by scraping or polishing the coating off, as, for example, described in U.S. Pat. No. 3,225,241. The polishing operation imposes special requirements on the composition of the reflecting coating as a special plasticiser must be added; such a plasticiser is, for example, dibutyl phtalate. Another disadvantage of this polishing operation is that electrostatic charge are aquired by the particles which are removed in the polishing operation so that they tend to jump onto the glass surface in the slot, which requires additional measures to prevent this phenomenon. Subsequent to the polishing operation the reflecting layer, which has a sharp boundary line owing to the polishing operation is sintered in order to remove the binder material and the plasticiser. It is necessary to add a binder to ensure a good layer structure and a proper adhesion of the reflecting layer to the wall. Finally a fluorescent coating is applied over the entire inner wall of the lamp envelope.

Sintering of the reflecting layer is an additional operation which increases the manufacturing costs of such a lamp. If sintering of this reflecting layer is omitted the reflecting layer is washed off to a greater or lesser degree when the fluorescent layer is applied. This results in that, in certain places, the reflecting layer can function no more and that the object the reflecting layer aims at, is reduced.

A method according to the invention is characterized in that the suspension or solution is sprayed in jets onto the inner wall of the tubular lamp envelope, with the plane through a jet which hits the part of the envelope which is immediately adjacent to the slot to be formed and parallel to the longitudinal axis of the lamp, being at an angle of less than 75° to the envelope which angle is open towards the slot to be formed and that jets situated in said plane are at an angle with the intersecting line of that plane and the envelope which exceeds 45°.

By spraying a suspension onto the tubular wall at an oblique angle it is possible to obtain a sharp boundary line between the coated portion and the uncoated portion. Namely, the jets so hit the innerside of the lamp envelipe that splashing into the direction of the slot-shaped portion which is not to be coated, is avoided.

Now the portions not to be coated need no longer be produced by means of the polishing operation. The addition of a plasticiser to the reflecting layer can be dispensed with. However, if no further measures are taken, the above-mentioned rinsing operation when applying the coating of fluorescent material is still necessary, so that sintering of this reflecting layer prior to the application of the fluorescent layer appeared unavoidable. Since the new method offers the possibility to dispense with the plasticiser, it is now possible to add a further material, for example $SiO_2$, to the suspension of the material for making the reflecting layer. The use of this material, which was previously impossible because the presence of the plasticiser rendered a fine dispersion of the $SiO_2$ in the suspension impossible, rinsing off of the reflecting layer when the fluorescent coating is applied is countered so that an intermediate rinsing operation is no longer required.

A further advantage of the method according to the invention is that the measures required to prevent the electrostatically charged particles from jumping onto the wall can be dispensed with.

Yet another advantage of a method according to the invention is that also in tubular envelopes with tapered ends the slot continuous till the end of the envelope which in practice is not possible when a slot if formed by means of polishing. Such a continuous slot is visually attractive.

The suspension is preferably sprayed by means of a nozzle which moves along the longitudinal axis relative to the inside of the envelope.

When used in an envelope which is arranged vertically or at least substantially vertically, the nozzle has a circular cross-section in which those spraying channels which are directed towards that portion of the envelope which is immediately adjacent to the slot-shaped portion of the envelope which should remain uncoated, are directed tangentially.

In general the nozzle will move at a uniform velocity through the envelope, but the viscosity of the suspension to be sprayed may cause this velocity to be varied, depending on whether the nozzle is at the top or at the bottom of the envelope. Deviations in the slot-width which depend on the viscosity of the suspension used can then be corrected by varying the speed of the nozzle. The width of the slot can be adjusted at choice by varying the position of the tangentially directed sparying channels. This width can also be adjusted by having the nozzle move non-coaxially along the longitudinal axis of the lamp envelope.

In a special embodiment of the nozzle according to the invention it is provided with a centering element, for example a leaf spring, which extends as far as the wall of the lamp envelope. This causes the position of the nozzle to remain constant relative to the lamp envelope and the slot width to remain the same all over.

The invention will be further explained hereinafter with reference to a drawing.

In this drawing FIG. 1 is a perspective view of a low-pressure mercury vapour discharge lamp provided with a longitudinal slot produced in accordance with a method of the invention.

Figure 1:
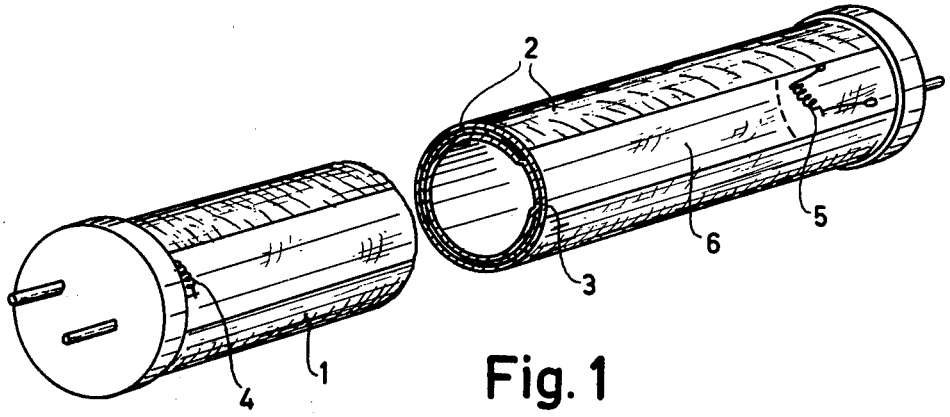

The lamp according to FIG. 1 has a glass envelope 1, which is coated on the inside with a reflecting layer 2 which is also shown in cross-section. The reflecting layer consists, for example, of titanium oxide. A layer of fluorescent material, indicated by 3 is applied over this layer 2. Thermally emitting electrodes 4 and 5 respectively are situated at both ends of the lamp. The longitudinal slot with sharp boundary is indicated by 6.

Figure 2:
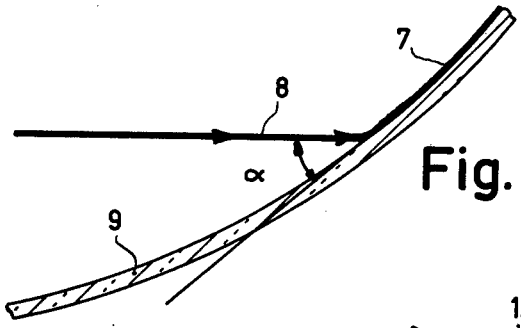
FIG. 2 is a cross-sectional view of a lamp envelope which receives a jet of a suspension or solution.

In FIG. 2 the lamp envelope is indicated by 7 on which a jet 8 of suspension or solution is incident in such a way that the portion of the envelope 9 which must remain uncoated stays free from splashes. This is the case when the angle $\alpha$ of the jet 8 with the envelope is smaller than 75°.

Figure 3:
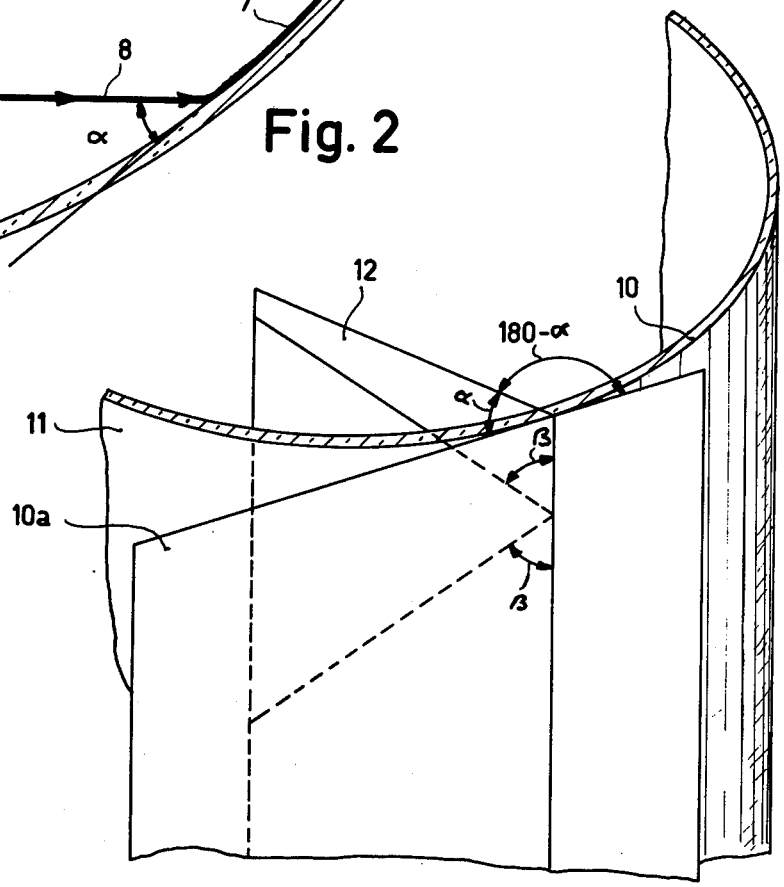
FIG. 3 depicts the possibility with which the inner wall of a tubular envelope can be sprayed to produce a slot with a sharp boundary on said inner wall.

In FIG. 3 reference 10 indicates the lamp envelope. The suspension or solution is sprayed in jets onto the inner wall of the tubular envelope 10. The plane through the jets which land on the portion of the envelope immediately adjacent to slot 11 to be formed is indicated by 12. This plane is parallel to the longitudinal axis of the tubular lamp envelope. The angle of this plane with the lamp envelope is indicated by $\alpha$ ($\alpha$ is the angle between the plane 12 and the tangential plane 10*a*). $\alpha$ is smaller than 75° and open towards the slot 11 to be formed. The jets which are in the plane 12 need not of necessity extend perpendicularly to the intersecting line of planes 10*a* and 12 but may land on the inner wall at an angle $\beta$ with the longitudinal axis, where $\beta$ exceeds 45°.

If $\beta$ is smaller than 45°, the angle of incidence of the jets would be so acute that splashes would yet land on the portion not to be coated.

Figure 4:
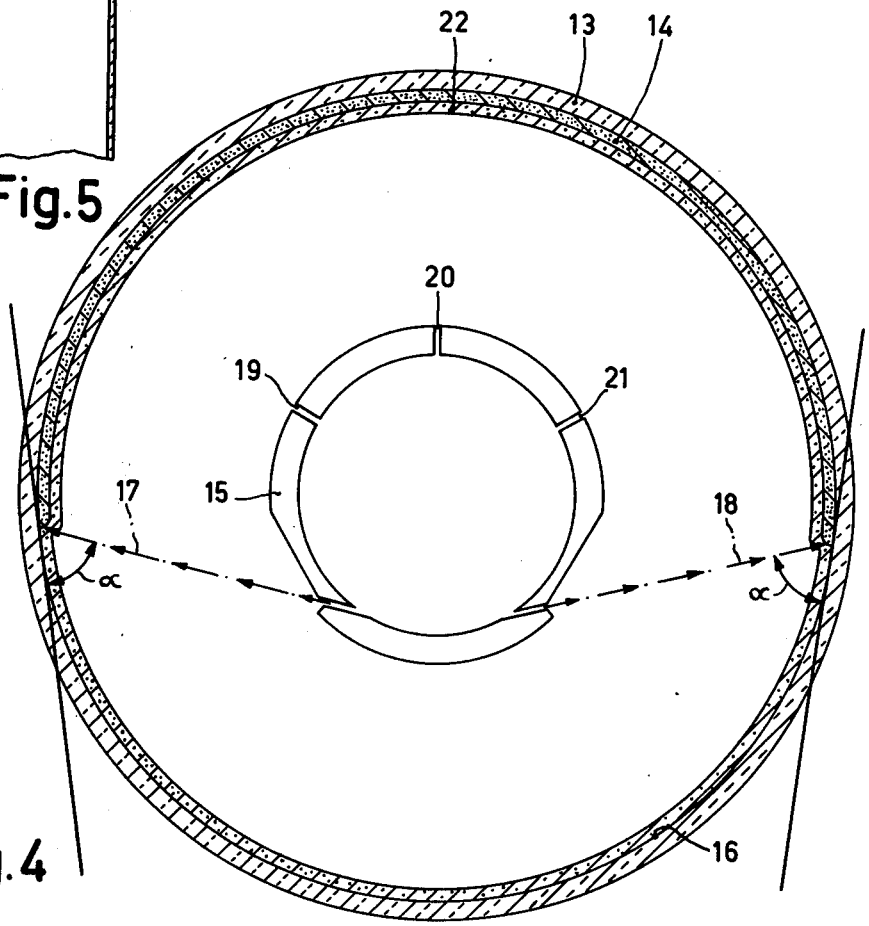
FIG. 4 shows a cross-sectional view of a nozzle, positioned inside a tubular lamp envelope for performing a method according to the invention.

In FIG. 4 reference 13 indicates the glass envelope of the lamp, the inner surface of which has been provided with a reflecting layer 14. This layer is applied by means of a nozzle 15 provided wth spraying channels. A longitudinal slot has been made in the reflecting layer. In the cross-sectional view this is shown by a portion of the lamp envelope 16 which is not coated with a layer of reflecting material. This longitudinal slot is produced by aiming the jets, at an oblique angle, at the portion of the envelope immediately adjacent to the longitudinal slot to be formed. These jets are indicated by 17 and 18. They land on the surface at an angle $\alpha$, which is smaller than 75° and which is open towards theportion not to be coated. The sparying channels 19, 20 and 21 are in the radial direction, these channels may be in any position provided no splashes from the jets coming from these channels can land on the portion of the envelope which must remain uncoated. It will be clear that there must be a sufficient number of radial channels to coat the portion of the envelope outside the portion 16 entirely. After applying the reflecting layer 14 the entire inner wall is coated with a layer of fluorescent material 22.

Figure 5:
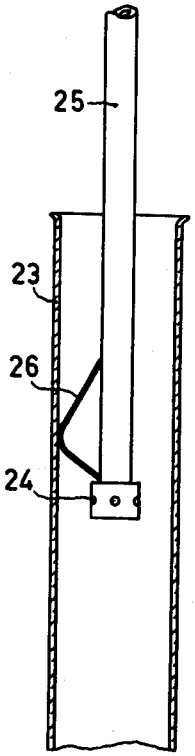
FIG. 5 shows a longitudinal section through a lamp envelope with associated nozzle.

In FIG. 5 reference 23 indicates the lamp envelope in which a longitudinal slot is being made by means of the method according to the invention. The nozzle 24 which is fitted to a long rod 25 travels along the longitudinal axis of this envelope. The nozzle is centered in the lamp envelope by means of a centering element 26, for example a leaf spring.

What is claimed is:

1. A method of applying a coat of a suspension or solution to the inner wall of a tubular lamp, which coat is provided with a longitudinal slot, which comprises: spraying the suspension or solution with a plurality of jets onto the inner wall of the tubular envelope of the lamp, after positioning said jets in a common plane which (1) intersects a portion of the envelope immediately adjacent to the slot to be formed (2) is parallel to the longitudinal axis of the lamp and (3) is disposed at an included angle of less than 75° intermediate said common plane and another plane which is tangentially disposed to said envelope at the line of intersection of said envelope and said common plane, said jets being also disposed at an angle greater than 45° with respect to the line defined by the intersection of said common plane and said envelope.

2. A method as claimed in claim 1, further including the step of moving said jets during said spraying step in the direction of the longitudinal axis of said lamp.

* * * * *